United States Patent [19]

Iwai

[11] Patent Number: 4,661,076

[45] Date of Patent: Apr. 28, 1987

[54] COWLING ASSEMBLY FOR AN OUTBOARD ENGINE

[75] Inventor: Tomio Iwai, Hamamatsu, Japan

[73] Assignee: Sanshin Kogyo Kabushiki Kaisha, Hamamatsu, Japan

[21] Appl. No.: 849,475

[22] Filed: Apr. 8, 1986

[30] Foreign Application Priority Data

Apr. 11, 1985 [JP] Japan ..... 60-75310

[51] Int. Cl.[4] ..... B63H 21/26

[52] U.S. Cl. ..... 440/77; 123/195 P; 440/900

[58] Field of Search ..... 440/76, 77, 900; 123/195 C, 195 P

[56] References Cited

U.S. PATENT DOCUMENTS 4,493,661 1/1985 Iwai ..... 440/77

FOREIGN PATENT DOCUMENTS 56-62299 5/1981 Japan .

5522997 2/1982 Japan ..... 440/77

*Primary Examiner*—Joseph F. Peters, Jr.
*Assistant Examiner*—Edwin L. Swinehart
*Attorney, Agent, or Firm*—Ernest A. Beutler

[57] ABSTRACT

Two embodiments of outboard motors including improved protective cowling arrangements for sealingly enclosing a liquid level tank. In each embodiment, a filler neck of the tank extends through an opening in a plate that is affixed relative to the starter handle and which is sealingly engaged with an opening in the protective cowling.

14 Claims, 3 Drawing Figures

Fig-2
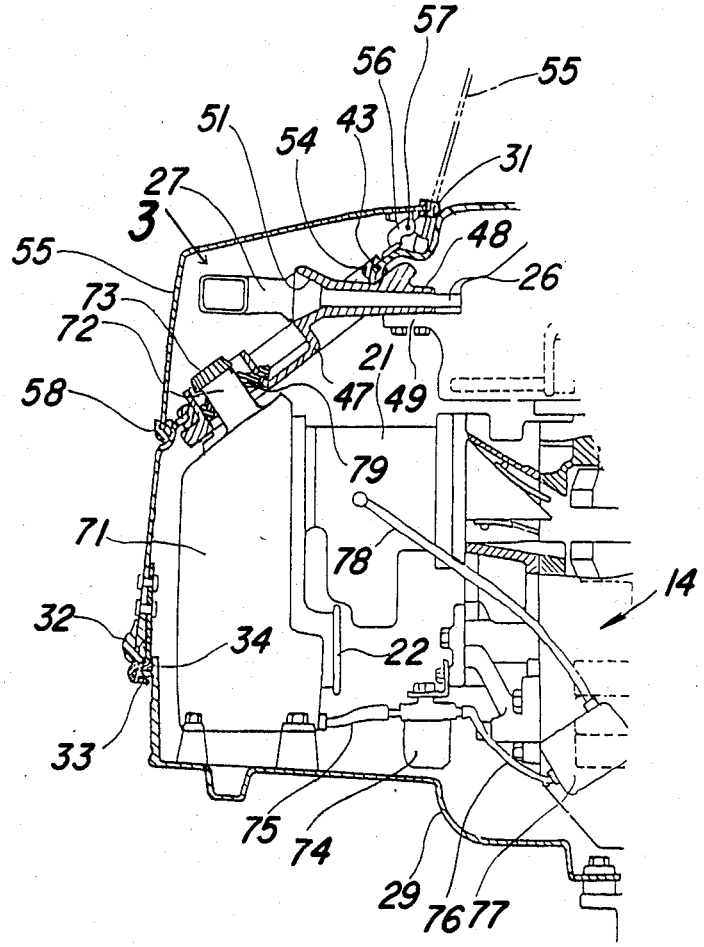
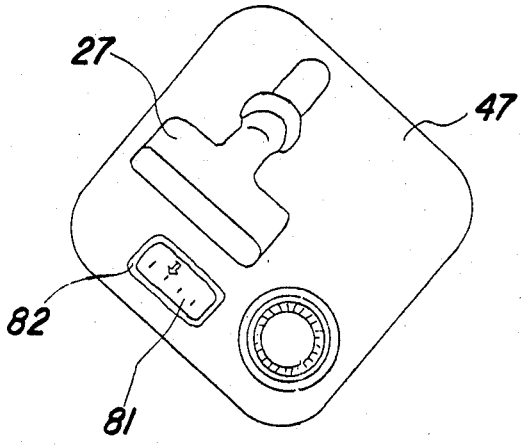
Fig-3

COWLING ASSEMBLY FOR AN OUTBOARD ENGINE

BACKGROUND OF THE INVENTION

This invention relates to an outboard motor and more particularly to an improved protective cowling arrangement for an outboard motor.

Generally, most outboard motors embody a power head that consists of the internal combustion engine which provides the power source for the motor and a surrounding protective cowling. The protective cowling encloses the outboard motor and is normally formed from a light weight material such as a molded plastic or the like. Frequently, there is contained within the protective cowling a liquid tank for holding a liquid for the engine. Such a liquid tank may hold gasoline or another fuel or, alternatively, a lubricant for the engine. If such a liquid tank is contained within the protective cowling, it is desirable to provide an arrangement wherein the tank may be filled without necessitating removal of the cowling. For this purpose, it has been proposed to provide an opening in the protective cowling through which the filler neck of the tank extends so as to facilitate filling.

Although such arrangements have utility, there is always a danger that liquid may seep between the filler neck and into the protective cowling due to spillage or other reasons. If the liquid for the tank is permitted to enter into the area enclosed by the protective cowling, there is the danger of contamination or, in some instances, even fire. Obviously, that is not a desirable situation.

With the prior art arrangements of this type, it has been proposed to provide a seal that is operative between the protective cowling and the filler tank neck. Although such seals are useful, the flexibility and light weight of the material from which the protective cowling is formed makes it difficult to insure a good seal under all circumstances. In addition, the material of the protective cowling and the manner in which it is formed does not alway offer the high degree of accuracy desired to provide the necessary seal.

It is, therefore, a principal object of this invention to provide an improved protective cowling arrangement for an outboard motor.

It is a yet further object of this invention to provide a protective cowling arrangement for an outboard motor that embodies a liquid tank and which insures good sealing around the neck and other components of the tank.

SUMMARY OF THE INVENTION

This invention is adapted to be embodied in an outboard motor having a power head positioned at the top of a drive shaft housing. The power head is comprised of an internal combustion engine, a pull starter having a pull handle for pull starting of the engine, a liquid tank for containing a liquid for the engine and supported in fixed relationship to the engine, and a filler neck for the tank in an upper surface thereof. A protective cowling encircles the engine and the liquid tank. In accordance with the invention, the protective cowling has an opening formed therein which is in proximity to the pull handle and to the filler neck for access thereto. A plate is affixed to the engine and has a guide portion for the rope of the pull starter. The plate has an opening for passing the filler neck and seal means surround the plate opening and sealingly engage the plate and the liquid tank for preventing spilled liquids from passing through the opening. The plate spans the protective cowling opening and seal means are disposed between the plate and the protective cowling around the protective cowling opening for precluding spilled liquids from entering into the protective cowling through its opening.

BRIEF DESCRIPTION OF THE DRAWINGS

FIG. 2 is a partial view, in part similar to FIG. 1, showing a second embodiment of the invention.

FIG. 3 is a view taken in the direction of the arrow 3 in FIG. 2.

DETAILED DESCRIPTION OF THE PREFERRED EMBODIMENTS

Figure 1:
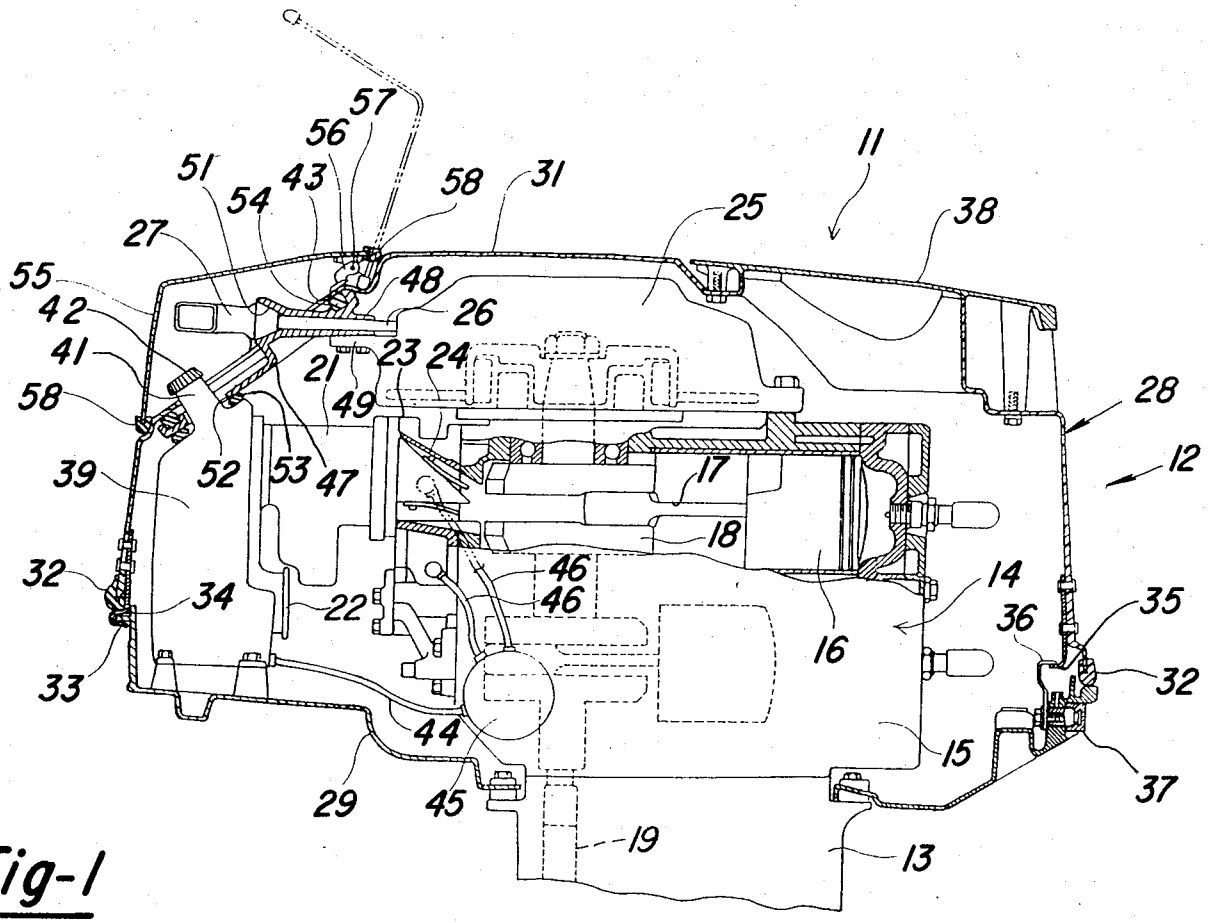
FIG. 1 is a side elevational view, with portions shown in section and other portions broken away or shown in phantom, of an outboard motor constructed in accordance with a first embodiment of the invention.

Referring first to the embodiment of FIG. 1, an outboard motor constructed in accordance with this embodiment is identified generally by the reference numeral 11. The outboard motor 11 includes a power head assembly, indicated generally by the reference numeral 12, which is positioned at the upper end of a drive shaft housing 13. Inasmuch as the invention relates to the construction of the power head assembly 12, the further components of the outboard motor have not been illustrated nor will they be described. It may be assumed that any conventional construction can be employed for these components.

The power head 12 includes an internal combustion engine, indicated generally by the reference numeral 14. The engine 14 may be of any known type and, in the illustrated embodiment, is depicted as comprising a two cylinder two-cycle crankcase compression engine. The engine 14 includes a cylinder block assembly 15 in which pistons 16 are supported for reciprocation in horizontally extending cylinder bores. The pistons 16 are connected by connecting rods 17 to a crankshaft 18 that rotates about a vertically disposed axis. The crankshaft 18 drives a drive shaft 19 that is rotatably journaled in the drive shaft housing.

An induction system is provided for delivering a fuel/air charge to the crankcase chambers of the engine 14. This induction system includes one or more carburetors 21 which draw from an air inlet device 22 and form a fuel/air mixture that is delivered to the crankcase chambers through an intake manifold 23 and respective reed-type check valves 24.

Affixed to the upper end of the crankshaft 18 is a pull type starter assembly which includes an outer housing 25. A rope 26 of the pull type starter carries a handle 27 at its outer end for pull starting of the engine 14 in a known manner.

A protective cowling, indicated generally by the reference numeral 28, encircles the engine 14. This protective cowling is comprised of a lower tray portion 29 that is affixed to an outstanding flange formed at the upper end of the drive shaft housing 13 and which underlies the engine 14. The protective cowling further includes an upper or main cowling portion 31 that has a peripheral flange which carries a seal 32 that is sealingly engaged with the outer periphery of the tray 29.

The main cowling portion 31 is affixed to the tray 29 by means including a clip 33 that is affixed to the forward portion of the main cowling portion 31. The clip 33 cooperates with a projection 34 carried at the front of the tray 29 to secure the elements together in this area. In addition, a hood 35 is provided at the rear portion of the main cowling 31 and is engaged by a rotatable latch 36 supported by the tray 29 to complete the attachment of the main cowling 31 to the tray 29. The rotatable latch 36 may be released by turning an operating handle 37 so that the main cowling 31 may be removed to afford access to the engine 14 and other components carried within the protective cowling 28.

The main cowling portion 31 has a separate, rear molded air duct 38 which is operative to provide an air inlet opening for admission of induction system air into the interior of the protective cowling 28 for entry into the engine induction system and particularly through the inlet device 22.

In accordance with this embodiment of the invention, the engine 14 is provided with a separate lubricating system which includes an oil tank 39 that is affixed relative to the engine 14 and which may be carried by the tray 29. The lubricant tank 39 is provided with a full neck 41 on which a filler cap 42 is attached. The filler cap 42 and fill neck 41 extend through an opening 43 which is formed in the upper forwardmost portion of the main cowling portion 31.

A conduit 44 conveys lubricant from the tank 39 to a crankshaft driven lubricant pump 45. The lubricant pump 45 delivers lubricant to the engine 14, for example, by means of conduits 46 that discharge into the intake manifold 23 downstream of the carburetor 21. Other forms of lubricant delivery may be employed without departing from the spirit of the invention.

The pull starter assembly 25 and specifically the starter rope 26 is supported within a metal guide plate, indicated generally by the reference numeral 47. The guide plate 47 has a bushing or guide portion 48 that receives and slidably supports the pull rope 26 adjacent the handle 27. This plate 47 is affixed to the engine and specifically to the pull starter housing 25 via a flange 49 of the latter. The forward end of the guide portion 48 is formed with a tapered opening 51 that receives and locates the handle 27 when it is in its retracted position.

In accordance with the invention, the plate 47 is formed with a downwardly extending portion that extends across and which spans completely the opening 43 in the outer cowling main portion 31. Adjacent the fill neck 41, the plate 47 is formed with an opening 52 that encircles the fill neck 41. An annular seal 53 encircles the opening 52 and is sealingly engaged with the plate 47 and the lubricant tank 39 so as to preclude any leakage of spilled lubricant into the interior of the protective cowling 28.

A seal 54 is also carried around the periphery of the plate 47 and is sealingly engaged with the main cowling portion 31 around its opening 43 so as to further insure against leakage.

A pivotally supported closure panel 55 is carried by the main cowling portion 31 by means of a hinge 56 via a hinge pin 57 and is pivotal between a closed position wherein the starter handle 27 and fill neck 41 and filler cap 42 are concealed and an opened position wherein access to these components is provided. The opened position is shown in phantom lines in FIG. 1. An annular seal 58 is carried around the periphery of the closure panel 55 so as to provide a water tight seal when the closure panel 55 is closed.

FIGS. 2 and 3 illustrate a further embodiment of the invention. This embodiment differs from the embodiment of FIG. 1 only in the construction and purpose of the liquid tank and, for that reason, the components which are the same as the previously described embodiment have been identified by the same reference numerals and will not be described again in detail.

In this embodiment, a fuel tank 71 is positioned within the outer cowling 23 and is supported on the tray 29 in fixed relationship to the engine 14. The fuel tank 71 has a filler neck 72 that receives a filler cap 43. The fuel tank 71 delivers fuel to a fuel filter 74 through a conduit 75. The fuel filter 74, in turn, delivers fuel through a conduit 76 to an engine driven fuel pump 77. The fuel pump 77 delivers the fuel to the carburetors 21 through a conduit 78.

In this embodiment, the plate 47 is formed with an opening through which the filler neck 72 extends. An annular seal 79 is received on the filler neck 72 and sealingly engages the opening in the plate 47. As with the previously described embodiment, the plate 47 spans the opening 43 of the upper cowling member 31.

The fuel tank is also provided with a fuel gauge 81 in its upper surface. An annular seal 82 encircles the fuel gauge and sealingly engages an area around an opening formed in the plate 47 that permits viewing of the filler gauge.

It should be readily apparent from the foregoing description that an improved arrangement is illustrated and described in each embodiment which permits the extension of a liquid tank fill neck through an opening in the outer cowling for filling but wherein a seal between this filler neck and a rigid plate affixed to the engine is provided so as to insure against any leakage of liquid spilled when filling the tank into the interior of the protective cowling. Although two embodiments of the invention have been illustrated and described, various changes and modifications may be made without departing from the spirit and scope of the invention, as defined by the appended claims.

I claim:

1. In an outboard motor having a power head positioned at the top of a drive shaft housing, said power head comprising an internal combustion engine, a pull starter having a housing fixed relative to said engine, a pull handle and rope for pull starting of said engine, a liquid tank for containing a liquid for said engine and supported in fixed relation to said engine, a filler neck for said tank in an upper surface thereof, and a protective cowling encircling said engine and said liquid tank, the improvement comprising said protective cowling having an opening formed therein in proximity to said pull handle and to said filler neck for access thereto, a plate affixed to said engine and having a guide portion for said rope of said pull starter, said plate having an opening passing said filler neck, first seal means surrounding said plate opening and sealingly engaging said plate and said liquid tank for preventing spilled liquids from passing through said opening, said plate spanning said protective cowling opening, and second seal means between said plate and said protective cowling around said protective cowling opening for precluding spilled liquids from entering said protective cowling through its opening.

2. In an outboard motor as set forth in claim 1 wherein the protective cowling further includes a pivotally supported cover operative, when in its closed position, to conceal the protective cowling opening, the pull handle for the pull starter and the liquid tank filler neck.

3. In an outboard motor as set forth in claim 1 wherein the plate is affixed to the pull starter housing.

4. In an outboard motor as set forth in claim 1 wherein the liquid tank comprises a lubricant tank for supplying lubricant to a lubricant pump driven by the engine for lubricating the engine.

5. In an outboard motor as set forth in claim 4 wherein the protective cowling further includes a pivotally supported cover operative, when in its closed position, to conceal the protective cowling opening, the pull handle for the pull starter and the liquid tank filler neck.

6. In an outboard motor as set forth in claim 5 wherein the plate is affixed to the pull starter housing.

7. In an outboard motor as set forth in claim 1 wherein the liquid tank is a fuel tank for delivering fuel to the engine.

8. In an outboard motor as set forth in claim 7 wherein the protective cowling further includes a pivotally supported cover operative, when in its closed position, to conceal the protective cowling opening, the pull handle for the pull starter and the liquid tank filler neck.

9. In an outboard motor as set forth in claim 8 wherein the plate is affixed to the pull starter housing.

10. In an outboard motor as set forth in claim 1 wherein the liquid tank includes a liquid level gauge supported in its upper surface and extending through the protective cowling opening.

11. In an outboard motor as set forth in claim 10 further including an opening in the plate passing the liquid level gauge and third seal means interposed between the plate and the liquid level tank around the liquid level gauge.

12. In an outboard motor as set forth in claim 11 wherein the protective cowling further includes a pivotally supported cover operative, when in its closed position, to conceal the protective cowling opening, the pull handle for the pull starter and the liquid tank filler neck.

13. In an outboard motor as set forth in claim 1 wherein the protective cowling is formed from a plastic and the plate is formed from a more rigid material.

14. In an outboard motor as set forth in claim 13 wherein the plate is formed form a metal.

* * * * *